US007828536B2

(12) United States Patent
Van Leuven

(10) Patent No.: US 7,828,536 B2
(45) Date of Patent: Nov. 9, 2010

(54) LOW-PRESSURE SCREW COMPRESSOR

(75) Inventor: Gert August Van Leuven, Lede (BE)

(73) Assignee: Atlas Copco Airpower, Naamloze Vennootschap, Wilrijk (BE)

( * ) Notice: Subject to any disclaimer, the term of this patent is extended or adjusted under 35 U.S.C. 154(b) by 195 days.

(21) Appl. No.: 11/990,754

(22) PCT Filed: Aug. 23, 2006

(86) PCT No.: PCT/BE2006/000089

§ 371 (c)(1),
(2), (4) Date: Feb. 21, 2008

(87) PCT Pub. No.: WO2007/022605

PCT Pub. Date: Mar. 1, 2007

(65) Prior Publication Data

US 2009/0232691 A1 Sep. 17, 2009

(30) Foreign Application Priority Data

Aug. 25, 2005 (BE) ..... 2005/0404

(51) Int. Cl.
*F01C 1/16* (2006.01)
*F01C 1/24* (2006.01)

(52) U.S. Cl. ..... 418/201.1; 384/517; 384/518

(58) Field of Classification Search ..... 418/201.1, 418/270; 384/517, 518, 454, 493, 494, 557, 384/563

See application file for complete search history.

(56) References Cited

U.S. PATENT DOCUMENTS 3,307,777 A * 3/1967 Schibbye ..... 418/201.1
3,388,854 A * 6/1968 Olofsson et al. ..... 418/203
3,414,189 A 12/1968 Persson
3,535,057 A * 10/1970 Kodra ..... 418/201.1
4,119,392 A * 10/1978 Breckheimer ..... 418/201.1
4,439,121 A * 3/1984 Shaw ..... 418/201.1
4,730,995 A * 3/1988 Dewhirst ..... 384/517
5,281,115 A * 1/1994 Timuska ..... 418/9
6,354,823 B1 3/2002 Becher et al.
6,994,531 B2 * 2/2006 Dairokuno et al. ..... 417/423.6
2004/0086409 A1 * 5/2004 Tsuboi ..... 418/201.1
2005/0058381 A1 * 3/2005 Kiyo ..... 384/565

(Continued)

FOREIGN PATENT DOCUMENTS

CH 156 842 A 8/1932

(Continued)

*Primary Examiner*—Thomas E Denion
*Assistant Examiner*—Mary A Davis
(74) *Attorney, Agent, or Firm*—Bacon & Thomas, PLLC

(57) ABSTRACT

Low-pressure screw compressor provided with a rotor housing (2) with an inlet side and an outlet side, and enclosing two rotor bodies (3 and 4) including shafts (5, 7 respectively) and screws (6, 8 respectively) mounted on the shafts. The rotor shafts (5 or 7) are bearing-mounted in the rotor housing (2), with the bearing mountings on the inlet side of the rotor housing each using a single loose bearing and the bearing mountings on the outlet side of the rotor housing each using a single fixed cylindrical roller bearing. Spring devices acting on the bearing mountings at the inlet side urge the shafts and rotors toward the outlet side to maintain minimum clearance between the rotors and the housing at the outlet side of the rotors.

10 Claims, 5 Drawing Sheets

U.S. PATENT DOCUMENTS

2005/0152628 A1* 7/2005 Egami et al. ..... 384/462
2007/0196228 A1* 8/2007 Tunna et al. ..... 418/201.1

FOREIGN PATENT DOCUMENTS

CH 495 509 A 8/1970
JP 60 003493 A 1/1985
JP 05133360 A * 5/1993
JP 08 121353 A 5/1996
WO WO 2005/033519 A 4/2005

* cited by examiner

LOW-PRESSURE SCREW COMPRESSOR

The present invention concerns an improved low-pressure screw compressor or what is called a screw blower.

In particular, the present invention concerns an improved low-pressure screw compressor which is provided with a rotor housing in which are provided two engaging rotor bodies which each consist of a shaft and a screw provided round the above-mentioned shaft, whereby the above-mentioned rotor bodies are provided in the above-mentioned rotor housing in a rotating manner as they are bearing-mounted with their respective shafts on either side inside the rotor housing.

Low-pressure screw compressors or what are called "screw blowers" are compressors which are particularly meant to supply a large flow of compressed gas at relatively low pressures, in other words pressures of usually one bar to three bar of relative pressure at the most in relation to the ambient pressure.

High-pressure screw compressors are already known, whereby for example the above-mentioned rotor bodies are bearing-mounted on their inlet side by means of a single-row cylindrical roller bearing and a four-point contact ball bearing, whereas on their outlet side, they are bearing-mounted by means of a single-row cylindrical roller bearing and an thrust bearing.

The presence of the above-mentioned thrust bearing is required with such known screw compressors, since considerable axial forces are exerted on the rotors while such high-pressure screw compressors are operational, such as gas forces and forces coming from driving gear wheels and/or synchronisation gear wheels.

A disadvantage of such known high-pressure screw compressors is that, because of said bearing arrangement, they are relatively expensive, and the mounting thereof is considerably time-consuming due to the relatively large number of bearings and the alignment thereof.

Another disadvantage of such known screw compressors is that the bearing arrangement is strongly overdesigned for low-pressure applications.

What are called "Roots blowers" are already known, which are provided with two engaging rotor bodies which are bearing-mounted in a rotor housing by means of, for example, a double-row angular contact ball bearing on one side of the rotor housing, and the combination of a spherical roller bearing with either a deep groove ball bearing or a cylindrical roller bearing.

Since known Roots blowers have only limited rotational speeds of three thousand revolutions per minute on average to five thousand revolutions per minute at the most, and the bearings are not loaded by axial forces, such a bearing arrangement is possible, but in the case of low-pressure screw compressors, which usually work at rotational speeds of six thousand revolutions per minute or more, the use of the above-mentioned standard two-row angular contact ball bearings is excluded because of the technical restrictions imposed by the bearing manufacturer.

The present invention aims to remedy one or several of the above-mentioned and other disadvantages.

To this end, the present invention concerns an improved low-pressure screw compressor which is provided with a rotor housing in which are provided two engaging rotor bodies which each consist of a shaft and a screw provided round the above-mentioned shaft, whereby the above-mentioned rotor bodies are provided in the above-mentioned rotor housing in a rotating manner as they are bearing-mounted with their respective shafts on either side inside said rotor housing, characterised in that each of the above-mentioned rotor bodies is bearing mounted, on the inlet side of the rotor housing by means of a single loose deep groove ball bearing and, on the outlet side of the rotor housing, by means of a fixed cylindrical roller bearing; and in that it is provided with means which push one or both rotor bodies to the outlet side of the rotor housing, which means are made in the shape of at least one spring which extends between the rotor housing and the rotor body, as a result of which the tip clearance between the rotor bodies and the rotor housing on the outlet side is minimized.

By "cylindrical roller bearings" are meant bearings with a concentric inner and outer ring, in between which are provided rotating roller elements which are made in the shape of cylindrical rollers.

By the term "deep groove ball bearing" is meant a bearing which is provided with a concentric inner and outer ring in which are provided continuous grooves opposite each other in between which are provided roller elements made in the shape of round balls.

In practice, such deep groove ball bearings are also called "groove ball bearings" or even, in short, "ball bearings".

An advantage of such an improved screw compressor according to the invention is that, thanks to the use of cylindrical roller bearings, they can be made compact since these bearings have only a limited axial width.

Another advantage of an improved low-pressure screw compressor according to the invention is that it is capable of absorbing large radial forces and that also axial forces can be absorbed via flanges of such cylindrical roller bearings.

Since the above-mentioned loose bearing is made in the shape of a deep groove ball bearing and means are additionally provided which push one or both rotor bodies to the outlet side of the rotor housing, the improved screw compressor according to the invention shows the advantage that, on the outlet side, the tip clearance between the screws and the rotor housing can be minimized, so that any loss of efficiency can be limited.

As the above-mentioned means which push one or both rotor bodies to the outlet side of the rotor housing are made in the shape of a spring which extends between the rotor housing and the screws of this rotor body, the improved screw compressor according to the invention is advantageous in that it has a simple construction, and in that the strength of the spring can be selected as a function of the dimensions and the operating characteristics of the screw compressor.

In order to better explain the characteristics of the present invention, the following preferred embodiment of an improved screw compressor according to the invention is given as an example only, with reference to the accompanying drawings, in which:

FIG. 1 schematically represents an improved low-pressure screw compressor according to the invention in perspective;

Figure 1:
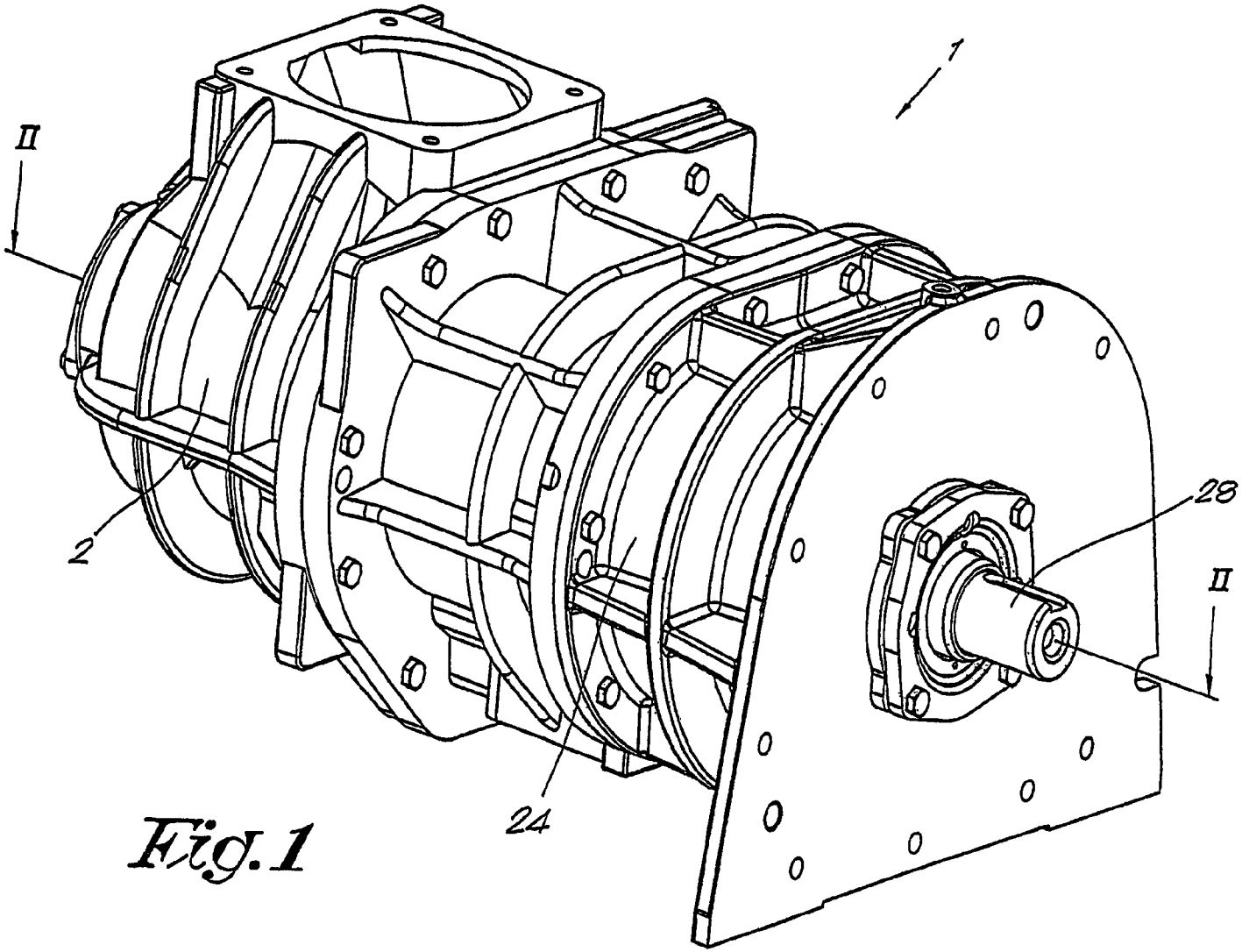
Figure 2:
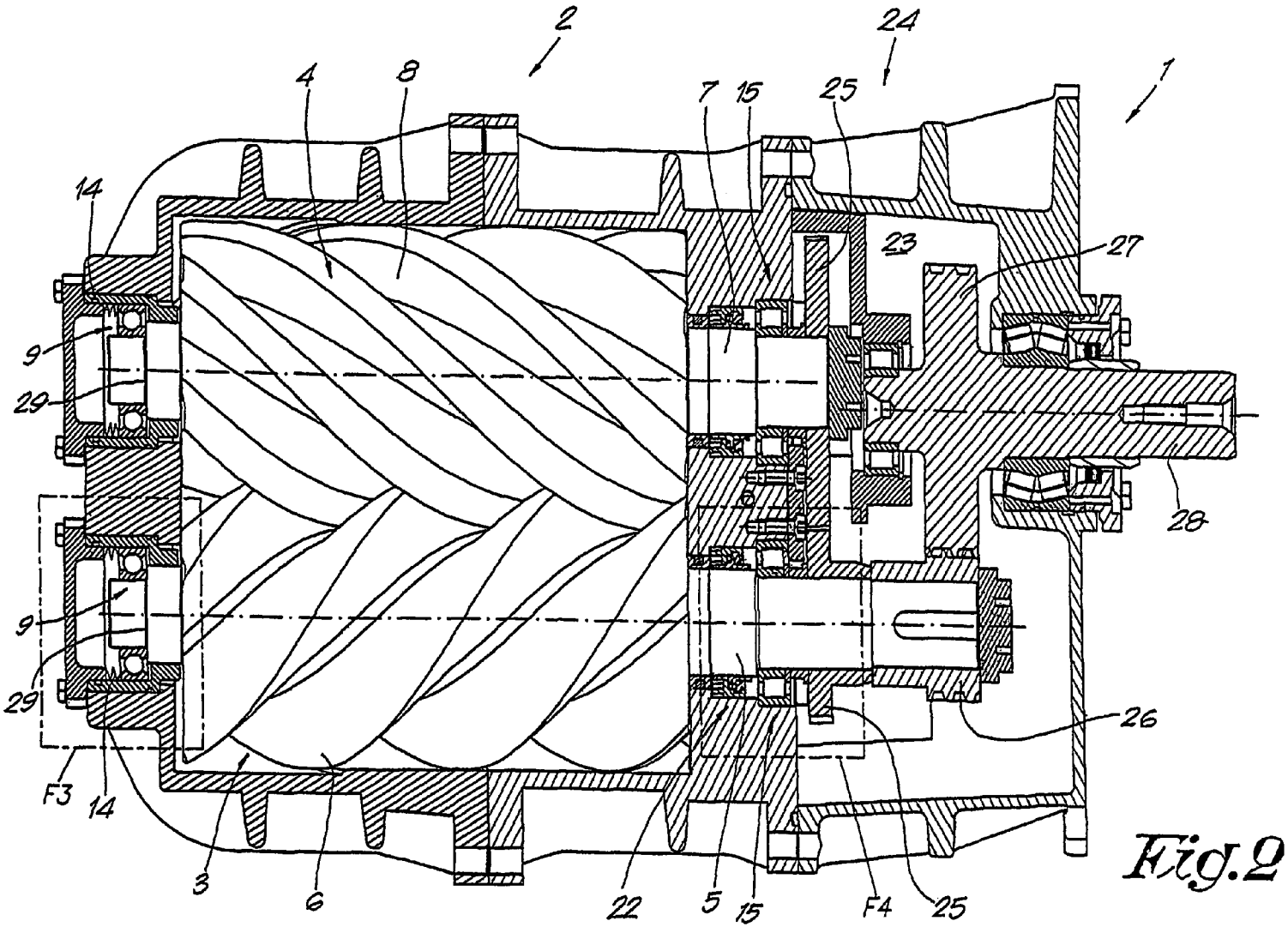
FIG. 2 is a section according to line II-II in FIG. 1.

FIGS. 1 and 2 represent an improved low-pressure screw compressor 1 according to the invention which is provided with a rotor housing 2 with an inlet side and an outlet side, and in which are provided two engaging rotor bodies 3 and 4, a driving rotor body 3 and a driven rotor body 4 respectively.

The driving rotor body 3 is built in the known manner in the shape of a shaft 5 around which extends a male screw 6, whereas the driven rotor body 4 is also formed in the known manner of a shaft 7 around which is provided a female screw 8 in which the above-mentioned male screw 6 engages.

The above-mentioned rotor bodies 3 and 4 can rotate in the above-mentioned rotor housing 2 as they are each bearing-mounted with their respective shafts 5 and 7 on either side inside said rotor housing 2.

According to the invention, the above-mentioned rotor bodies 3 and 4 are bearing-mounted on the inlet side of the rotor housing 2 by means of a single loose bearing 9 which, preferably but not necessarily, is made in the shape of a single-row, greased, deep groove ball bearing.

By a single-row bearing is meant a bearing in this case which, seen in the axial direction, is provided with only a single row of roller elements.

In this case, each of the above-mentioned deep groove ball bearings 9 will be loose, as they are provided with an outer ring 10 which is provided in the above-mentioned rotor housing 2 in such a manner that it can shift in the axial direction of a respective rotor body 3 or 4.

The respective inner rings 11 of each of the above-mentioned deep groove ball bearings 9 are in this case fixed to a shaft 5, 7 respectively of a rotor body 3, 4 respectively.

Between the above-mentioned outer and inner ring 10 and 11 are provided roller elements 12 in the shape of round balls which are usually held in the known manner in a cage which is not represented in the figures.

If the above-mentioned deep groove ball bearings 9 are greased, the bearings 9 will preferably be sealed in a double-sided manner. Of course, according to the invention, it is not excluded for the above-mentioned deep groove ball bearings 9 to be oil-lubricated.

Figure 3:
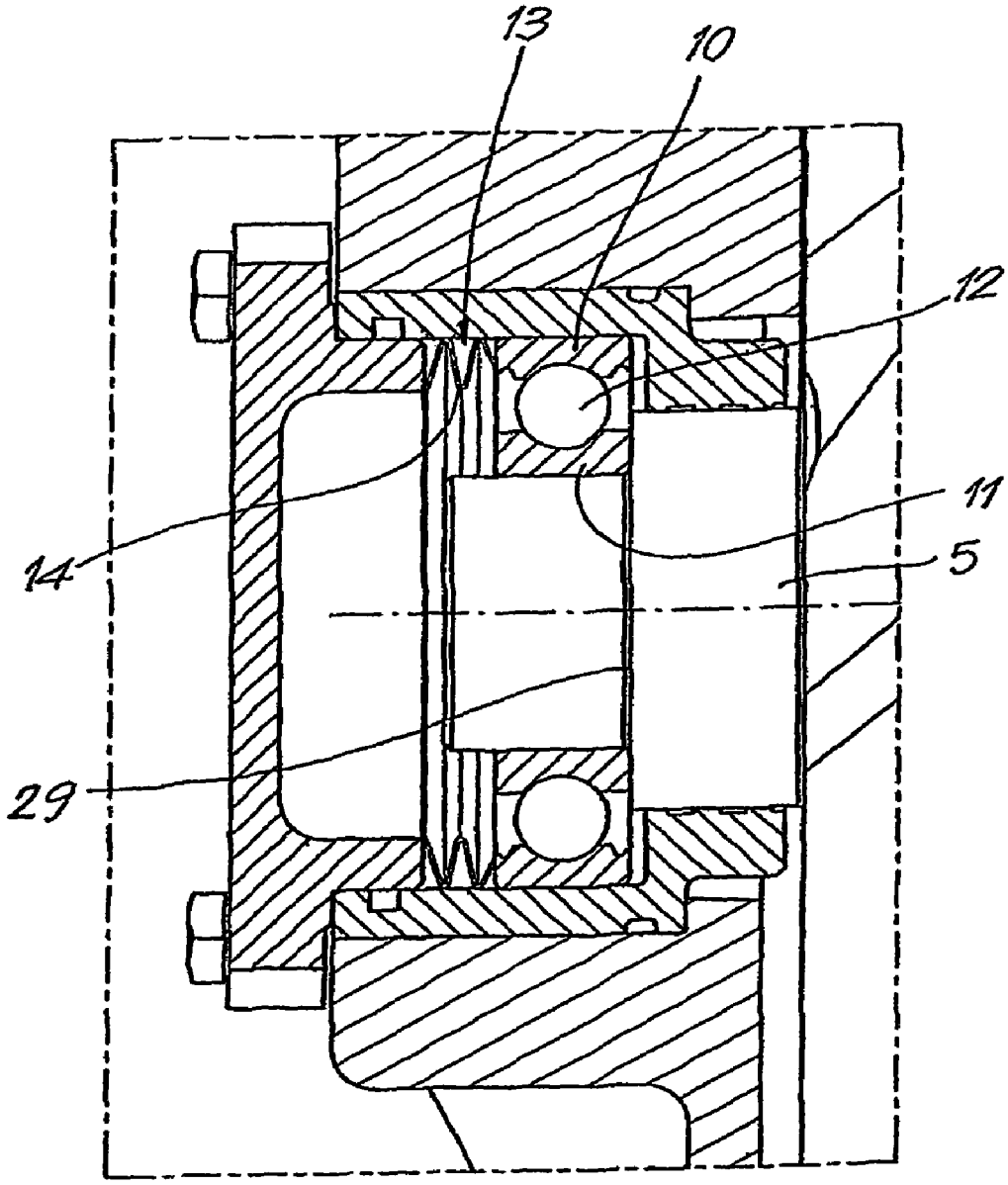
FIGS. 3 and 4 represent the parts indicated in FIG. 2 by F3 and F4 respectively, to a larger scale.

As is represented in detail in FIG. 3, the screw compressor 1 is in this case, but not necessarily, provided with means 13 which push at least one and in this case both rotor bodies 3 and 4 to the outlet side of the rotor housing 2.

The above-mentioned means 13 are preferably made in the shape of at least one spring 14 which extends between the rotor housing 2 and the respective rotor bodies 3 and 4, which springs 14 in this case push indirectly against the rotor bodies 3 and 4 via the outer ring 10 of a respective deep groove ball bearing 9.

On the outlet side of the rotor housing 2, each of the respective shafts 5 and 7 of the rotor bodies 3 and 4 according to the invention are bearing-mounted by means of a single, fixed cylindrical roller bearing which is preferably but not necessarily made in the shape of a single-row, oil-lubricated cylindrical roller bearing 15.

According to the invention, it is not excluded for the above-mentioned bearings 9 and/or 15 to be made in the form of two-row or multiple-row bearings.

Figure 4:
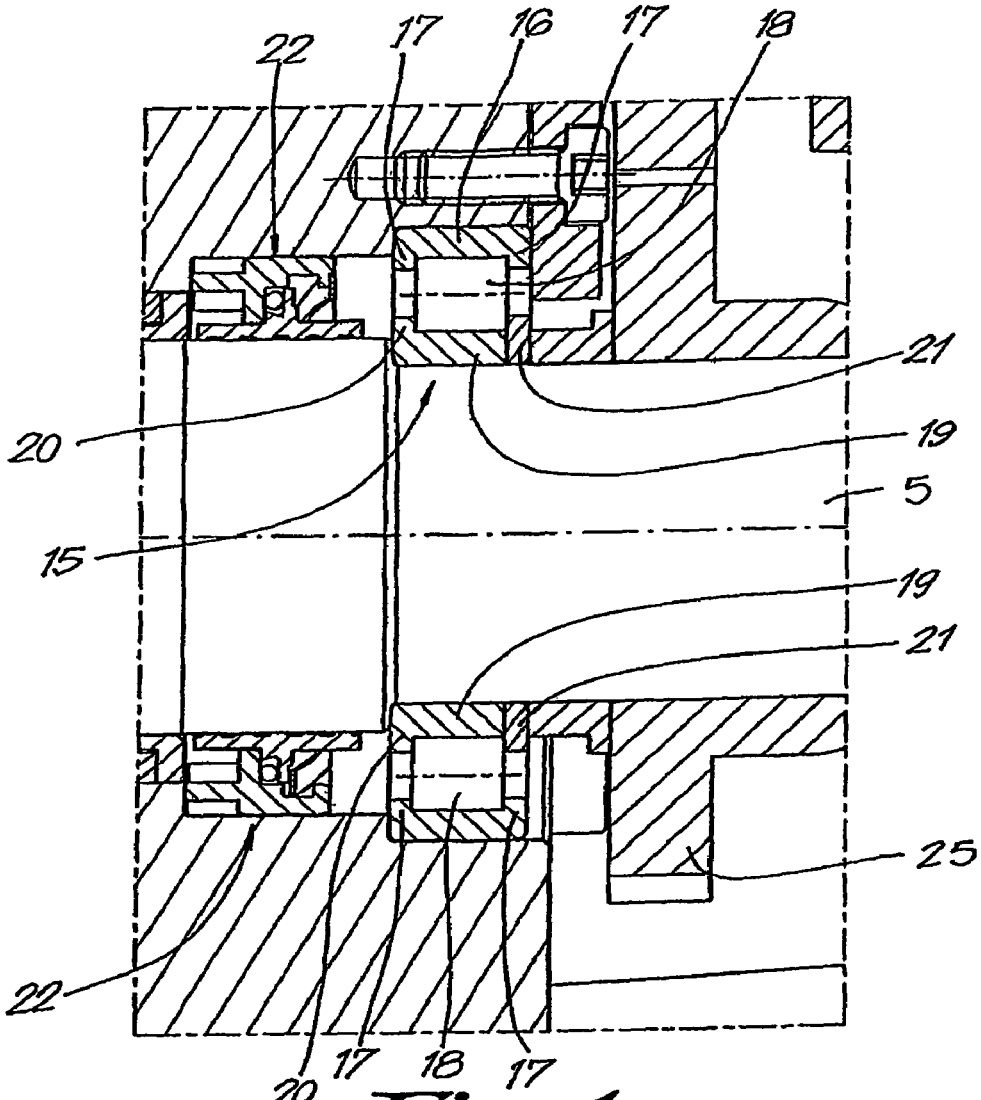

As is represented in detail in FIG. 4, the above-mentioned cylindrical roller bearing 15 is in this case made in the shape of what is called a NUP bearing which, in other words, is provided with a fixed outer ring 16 provided inside the rotor housing 2 with two fixed flanges 17 which confine the runner surface of the roller elements 18.

Such a NUP cylindrical roller bearing is also provided with an inner ring 19 which is provided with only one fixed flange 20 against which the above-mentioned roller elements 18 are provided with one side edge.

Opposite the other side edge of the above-mentioned roller elements 18 of the cylindrical roller bearing 15 is provided a loose, removable flange 21 in case of such a NUP bearing.

In this case, the cylindrical roller bearings 15 are erected such that their respective fixed flange 20 are situated on the sides of the cylindrical roller bearings 15 opposite the screws 6 and 8.

Figure 5:
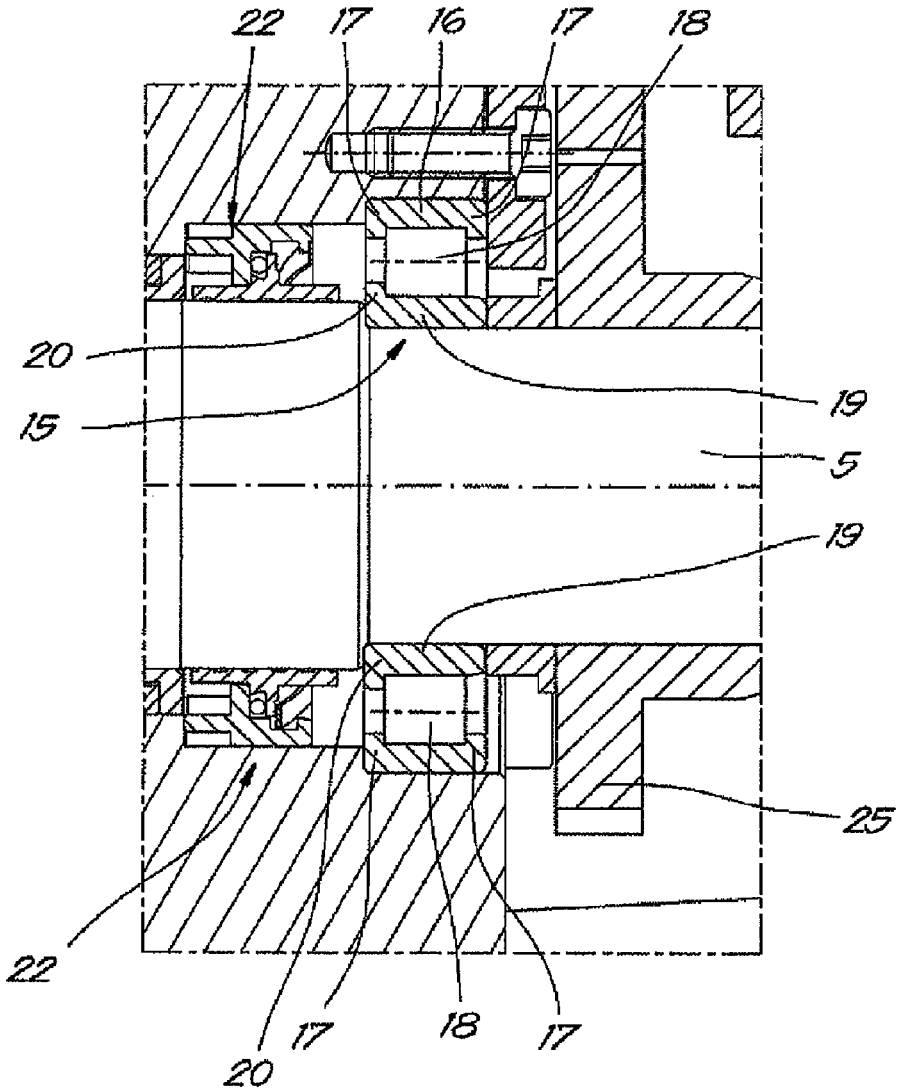
FIG. 5 is a view similar to FIG. 4, and representing an NJ cylindrical roller bearing, to a larger scale.

However, it is also possible according to the invention for the above-mentioned cylindrical roller bearing 15 to be made in the shape of what is called an NJ bearing, as shown in FIG. 5, whereby the outer ring 16 is provided with two fixed flanges 17 and the inner ring 19 is provided with only one fixed flange, but whereby no second, loose flange is provided.

An advantage of such NJ bearings is that they are cheaper than the above-mentioned NUP bearings and that the mounting of such NJ bearings takes little time, as such bearings are made of several parts, which strongly simplifies the dismantling and mounting of the compressors, so that less man hours are required for manufacturing, maintenance, repair and the like.

In this case is provided round every shaft 5 and 7, between the screw 6, 8 respectively and the cylindrical roller bearing 15, a mechanical sealing 22.

On the other side of the cylindrical roller bearings 15, both shafts 5 and 7 of the rotor bodies 3 and 4 extend so as to form two free shaft ends which extend up to a sealed room 23 in a transmission housing 24 which is provided against the above-mentioned rotor housing 2 or which is a part thereof.

In the above-mentioned transmission housing 24 is provided round each of the above-mentioned free shaft ends a synchronisation gear 25 in this case.

On the free end of the shaft 5 of the driving rotor body 3 is in this case also provided a gear wheel 26 which engages in a gear wheel 27 working in conjunction with it, which is provided on a shaft 28 which is coupled to a driving motor which is not represented in the figures.

The working of an improved low-pressure screw compressor 1 according to the invention is very simple and as follows.

By activating the driving motor, via the driving gears 26 and 27, the driving rotor body 3 is driven, which in turn, via the synchronisation gears 25, drives the driven rotor body 4.

As the screws 6 and 8 engage, an amount of gas is compressed between these screws 6 and 8 in the known manner, which is sucked in on the inlet side of the rotor housing 2 and which leaves the rotor housing 2 in a compressed form via the outlet which is not represented.

The freshly drawn-in inlet gas hereby has a cooling effect on the above-mentioned deep groove ball bearings 9 on the inlet side of the rotor housing 2, so that grease lubrication can be applied.

Axial forces which are exerted on the rotor bodies 3 and 4 are absorbed by the above-mentioned deep groove ball bearing 9, as well as by the cylindrical roller bearing 15.

Thanks to the specific bearing arrangement according to the invention, an improved low-pressure screw compressor 1 is much more appropriate for high rotational speeds than conventional Roots blowers which make use of angular contact ball bearings.

The axial driving forces are transmitted by the driving gears 26 and 27, and the gas forces which are created by the compression of the gas between the above-mentioned screws 6 and 8 make sure that the rotor bodies 3 and 4 are pushed to the inlet side of the rotor housing 2 during the operation of the screw compressor 1.

In the case where use is made of a NUP bearing according to any one of the possibilities of the invention, these axial forces can be absorbed, however, by the flanges 17 and 20 of the cylindrical roller bearings 15 which prevent their roller elements 18 from moving to the rotor housing 2 and which are preferably oil-lubricated to this end.

Since the outer rings 10 of the deep groove ball bearings 9 are provided in the rotor housing 2 in such a manner that they can shift according to the axial direction of the respective rotor shafts 5 and 7, the forces exerted on said outer rings 10 by the above-mentioned means 13 are transferred via the balls 12 to the inner rings 11 which push against a collar 29 of the above-mentioned shaft 5, 7 respectively.

Thanks to the pushing forces of the means 13, the rotor bodies 3 and 4 are always forced to the outlet side of the rotor housing 2, also during the operation of the screw compressor 1, so that the above-mentioned axial forces, as a result of the gas compression and possibly of the gear wheel transmissions, are compensated and the fixed flanges 20 and 17 of the cylindrical roller bearings 15 are loaded less.

This is of course advantageous to the life of these cylindrical roller bearings 15 and, as a consequence, the period between two maintenance services of such an improved compressor according to the invention is extended.

Another advantage of the presence of the above-mentioned means 13 is that the tip clearance between the screws 6 and 8 and the rotor housing 2 on the outlet side of the rotor housing 2 is always kept to a minimum, so that losses are prevented and the output of the compressor 1 increases, and as a result of which the compressor 1 will work in a stable manner, also at low outlet pressures.

Another advantage of the above-mentioned means 13 is that the bearing 9 cannot shift off the shaft 5; otherwise, an extra locking is required on the inner or outer ring.

Another advantage of the above-mentioned means 13 is that the bearing 9 is pre-stressed, so that there is always the necessary minimal load on the bearing 9, which guarantees a stable operation.

It is clear that the presence of synchronisation gears 25 according to the invention is by no means necessary, since the screws 6 and 8 can also drive each other directly.

Also, it goes without saying that the present invention is not restricted to oil-free low-pressure screw compressors, but that it can also be applied in oil-injected low-pressure screw compressors.

It goes without saying that the above-mentioned means 13 which push one or both rotor bodies 3 and/or 4 to the outlet side of the rotor housing 2 according to the invention can be made in many ways, for example in the form of one or several conventional compression springs, one or several cup springs, one or several leaf springs or any other type of spring which is suitable.

Moreover, the above-mentioned means 13 according to the invention can be made for example in the form of a fluid put under pressure, which transfers forces, either or not by means of a transmission element, to the above-mentioned rotor bodies 3 and 4.

According to the invention, the above-mentioned loose bearing is not restricted to a deep groove ball bearing 9, but in another embodiment it can also be realised as another type of bearing, such as for example in the form of a cylindrical roller bearing of the NU type, whereby the inner ring 11 has no flanges and the outer ring 10 is provided with two fixed flanges in between which are provided roller elements 12 in the shape of rollers, or of the NJ type whereby the inner ring 11 has only one flange.

The present invention is by no means restricted to the embodiments given as an example and represented in the drawings; on the contrary, such an improved low-pressure screw compressor 1 according to the invention can be made in all sorts of shapes and dimensions while still remaining within the scope of the invention.

The invention claimed is:

1. Low-pressure screw compressor including a rotor housing having an inlet side and an outlet side; two engaging rotor bodies each including a shaft and a screw provided around each shaft such that said rotor bodies are rotatably supported in the rotor housing by said shafts; said shafts being bearing-mounted at each end inside said rotor housing; the bearing mounting of each shaft on the inlet side of the rotor housing comprises a single loose deep groove ball bearing and the bearing mounting on the outlet side of the rotor housing comprises a fixed cylindrical roller bearing; a spring device located between the rotor housing and the rotor body arranged to urge one or both rotor bodies towards the outlet side of the rotor housing, so that a minimum axial clearance between the rotor bodies and the rotor housing on the outlet side is maintained.

2. Low-pressure screw compressor according to claim 1, wherein each said loose deep groove ball bearing includes an outer ring arranged to be moveable in the rotor housing in the axial direction of said respective rotor bodies.

3. Low-pressure screw compressor according to claim 1, wherein the cylindrical roller bearing comprises a single-row cylindrical roller bearing.

4. Low-pressure screw compressor according to claim 1, wherein the cylindrical roller bearing is oil lubricated.

5. Low-pressure screw compressor according to claim 1, wherein the cylindrical roller bearing comprises a NUP bearing.

6. Low-pressure screw compressor according to claim 1, wherein the cylindrical roller bearing comprises an NJ bearing.

7. Low-pressure screw compressor according to claim 1, wherein the deep-groove ball bearing comprise a single-row bearing.

8. Low-pressure screw compressor according to claim 1, wherein the deep-groove ball bearing is lubricated by grease.

9. Low-pressure screw compressor according to claim 1, wherein at least one of the deep groove ball bearings is sealed in a double-sided manner.

10. Low-pressure screw compressor according to claim 1, further comprises two of said spring device wherein each pushes against a respective outer ring of said respective deep groove ball bearing.

* * * * *